US010139178B2

(12) United States Patent
Lyren et al.

(10) Patent No.: US 10,139,178 B2
(45) **Date of Patent: *Nov. 27, 2018**

(54) FIREARM WITH USER AUTHENTICATION TO REMOVE OR ADD COMPONENTS

(71) Applicants: Philip Scott Lyren, Hong Kong (CN); James Alexander Eugene Lyren, King of Prussia, PA (US); William Christopher Lyren, Wadsworth, OH (US)

(72) Inventors: Philip Scott Lyren, Hong Kong (CN); James Alexander Eugene Lyren, King of Prussia, PA (US); William Christopher Lyren, Wadsworth, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/713,612

(22) Filed: Sep. 23, 2017

(65) Prior Publication Data

US 2018/0031344 A1 Feb. 1, 2018

Related U.S. Application Data

(63) Continuation of application No. 15/093,696, filed on Apr. 7, 2016, now Pat. No. 9,791,231.

(51) Int. Cl.

| | |
|---|---|
| ***F41A 17/06*** | (2006.01) |
| ***F41A 11/02*** | (2006.01) |
| ***F41C 23/10*** | (2006.01) |

(52) U.S. Cl.

CPC ..... *F41A 17/063* (2013.01); *F41A 11/02* (2013.01); *F41A 17/066* (2013.01); *F41C 23/10* (2013.01)

(58) Field of Classification Search

CPC ..... F41A 17/00; F41A 17/06; F41A 17/063; F41A 17/066; F41A 17/20; F41A 17/30; F41A 11/00; F41A 11/02

See application file for complete search history.

(56) References Cited

U.S. PATENT DOCUMENTS

| | | | | |
|---|---|---|---|---|
| 6,856,238 | B2 * | 2/2005 | Wootton | F41A 17/063 340/10.1 |
| 9,115,944 | B2 * | 8/2015 | Arif | F41A 17/063 |
| 9,400,150 | B2 * | 7/2016 | Stewart | H04W 4/70 |
| 9,791,231 | B1 * | 10/2017 | Lyren | F41A 17/063 |

* cited by examiner

*Primary Examiner* — Stephen Johnson

(57) ABSTRACT

A method authenticates a user before the user can remove or attach a component to a firearm. When the user is authenticated, the user can remove or attach a component to the firearm. The firearm prevents the removal or attachment of the component when the user is not authenticated.

20 Claims, 6 Drawing Sheets

FIREARM WITH USER AUTHENTICATION TO REMOVE OR ADD COMPONENTS

This application is a continuation of U.S. patent application Ser. No. 15/093,696, filed on Apr. 7, 2016, now U.S. Pat. No. 9,791,231.

BACKGROUND

Handguns, rifles, and other firearms are continually evolving to make them more reliable and safer. Many portable guns now include some form of electronics that assist in these endeavors.

Advancements in firearms and firearm technology that increase safety will be welcome in this technological field.

SUMMARY OF THE INVENTION

Figure 1:
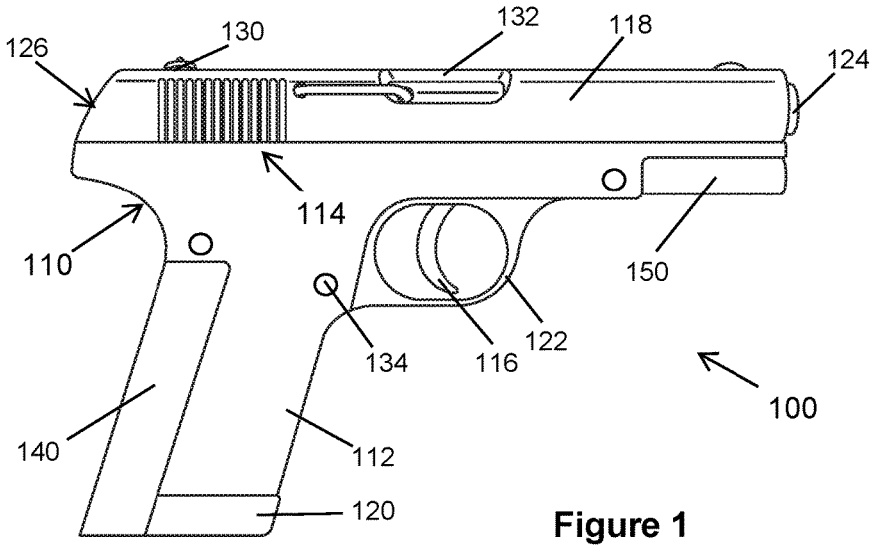
FIG. 1 is a firearm that includes removable modules or components in accordance with an example embodiment.

One example embodiment is a method that authenticates a user before the user can remove or attach a component to a firearm. When the user is authenticated, the user can remove or attach a component to the firearm. The firearm prevents the removal or attachment of the component when the user is not authenticated.

Other example embodiments are discussed herein.

DETAILED DESCRIPTION

Example embodiments relate to methods and apparatus that include a firearm assembly in which removable components attach to and remove from firearms. These components enable a user to select from different functions that include a variety of different electronic components and components with no electronics. As one example, users can quickly change a firearm from being a smart-gun to being a traditional firearm without electronics or being a firearm with limited or specific electronics.

One problem is that firearms are sold as either being a traditional firearm with no electronics or a firearm with electronics, such as a smart-gun. For example, if a user wants to own a smart-handgun and a traditional handgun, then the user would have to buy two separate handguns, one being the smart-handgun and one being the traditional handgun. A firearm assembly or system of an example embodiment solves this problem since the user can purchase a single firearm and then transform this firearm back-andforth from between a firearm with electronics (such as a smart-gun) and a traditional firearm.

Another problem is that firearms with electronics can be modified, altered, assembled, or disassembled without user authentication or without the modifications being determined and stored. Firearms can be safer if the firearm, their components, and/or the configurations of the firearms are determined and stored. Further, authenticating a user to add or remove components from a firearm can also increase firearm safety. A firearm assembly or system of an example embodiment solves these problems.

One example embodiment is a firearm assembly that includes multiple different components, modules, and/or modular components that connect to a base unit, frame, body, or other portion of the firearm. By way of example, the components can enable a user to transform the firearm from being a traditional firearm to being a firearm with electronics. Furthermore, the components enable a user to select between different functions. For example, one component includes electronics that provide the firearm with a first set of functions; a second component includes different electronics that provide the firearm with a second set of functions; etc. A user can thus build or assembly a firearm with different functions by changing components of the firearm.

Another example embodiment includes a firearm assembly with multiple different components or modules that connect to the firearm. The firearm has one or more locking mechanisms that lock the modules or components such that an unauthenticated user cannot remove or add a module or component without first being authenticated. When a user is not authenticated, the locking mechanism actuates to lock the modules and/or components to the firearm. These components cannot be removed when locked. When the user is authenticated, the locking mechanism actuates to unlock the modules and/or components.

In an example embodiment, the locking mechanism automatically actuates the lock when the component or module connects to the firearm. For example, the locking mechanism includes a retractable pin or cylinder that slides or moves into a hole or recess located in the component or module. When the component connects to the firearm, a "lock" signal generates and actuates the locking mechanism to move the pin or cylinder into the hole or recess. The pin or cylinder cannot be actuated to move out of the hole or recess until a user is authenticated to the firearm.

A single firearm can have multiple different types of authentications. These authentications are in addition to or different than an authentication as to whether a particular user is authorized to fire the firearm. Instead, these authentications extend to individual components of the firearm or certain configurations or versions of an assembled firearm. For example, each component can have a unique set of rules for who is authorized to attach the component, remove the component, fire the firearm with the component, etc.

Consider an example in which three different users are authorized to fire the firearm when a first component is attached to the firearm (for example, the first component is a scope). Only one of these users is authorized to fire the firearm when a second component is attached to the firearm (for example, the second component is a suppressor). None of the three users are authorized to attach a third component to the firearm (for example, the third component is a high-capacity magazine). Only two of the users are authorized to remove the first component from the firearm. These examples show how authorization can extend to a particular component and/or a particular configuration of an assembled firearm.

FIG. 1 is a firearm 100 shown by way of example as a handgun. The firearm 100 includes a frame or main body 110, a grip or handle 112 that extends outwardly from the body, an action 114 (including components located inside the body) that can load, lock, fire, and/or extract ammunition, a trigger 116 that actuates the action to fire a bullet loaded in the firearm, and a barrel 118 located on top of the body 110. The firearm 100 also includes a removable magazine 120 that houses cartridges, a trigger guard 122 that protects the trigger 116, a muzzle 124 located a front of the firearm, a breach 126 located at the back or rear of the firearm, one or more sights 130 located on the barrel, an ejection port 132 that ejects cartridge casings, and a safety mechanism or magazine ejection 134 (shown as a button).

The firearm 100 also includes two different modules or components 140 and 150. One module or component 140 connects to, engages with, or forms part of the grip or handle 112. Another module or component 150 connects to, engages with, or forms part of the body 110 adjacent to and underneath the barrel 118.

The modules or components 140 and 150 can be located at different locations on and/or in the firearm, such as being inside the body, on the grip or handle, and on or attached to the barrel.

As one example, module or component 140 is located adjacent to or with the grip or handle 112. For instance, this module or component can be formed as part of the grip or handle, formed as a separate piece from the grip or handle, or formed as being the entire grip or handle. The module or component 140 extends parallel with the magazine 120 on a breach side or back side of the handgun and has an elongated shape, such as a cylindrical, rectangular, shape with rounded sides, or other shape to complete or form the handle or a portion of the handle.

As one example, module or component 150 is located adjacent to or with the body along or at an underside of the barrel 118. For instance, this module or component can be formed as part of the body or formed as a separate piece from the body. The module or component has an elongated shaped, such as a cylindrical shape or rectangular shape. Further, a heat shield or heat shielding device can be located on the module or component 150 or located between the module and component and the barrel to protect from heat generated from the barrel when the firearm is fired.

Figure 2:
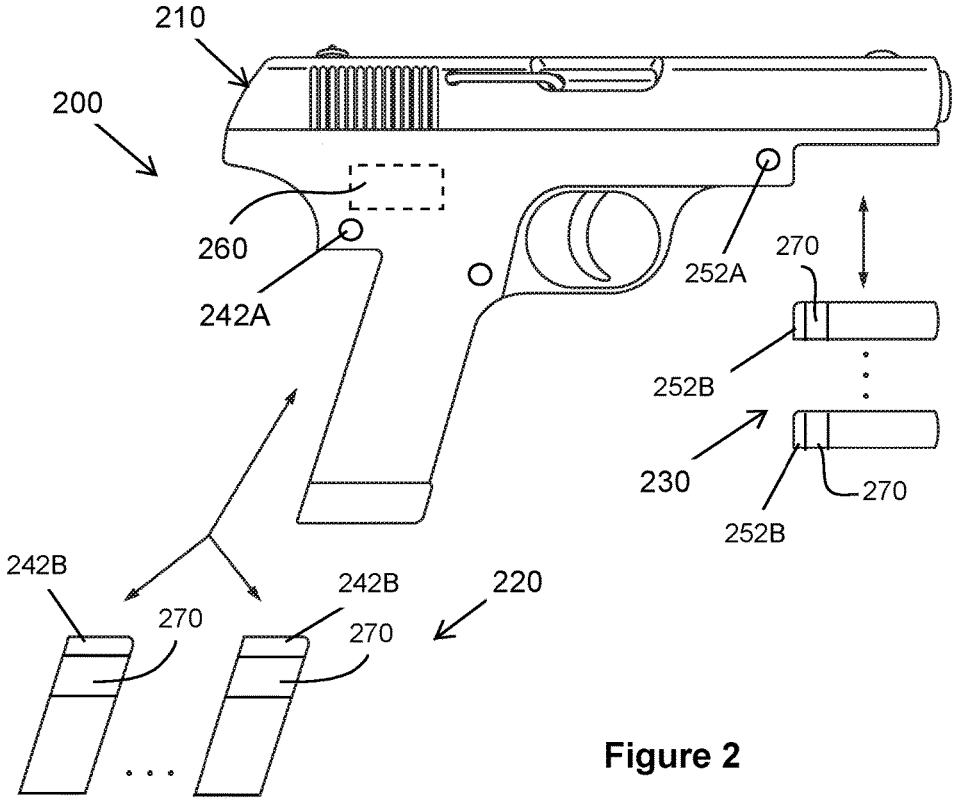
FIG. 2 is a firearm assembly that includes a firearm and a plurality of modules or components in accordance with an example embodiment.

FIG. 2 shows a firearm assembly 200 that includes a firearm 210, a first set of modules or components 220, and a second set of modules or components 230. By way of example, the firearm can be similar to the handgun in FIG. 1.

The modules, components, or modular components can be attached to and removed from the firearm to provide the firearm with different features and functions. They can be electronic and/or mechanical devices that are separate and standalone devices, such as an electronic device that functions when removed from the firearm. For instance, the electronic device is or includes a rangefinder that functions to determine distances to objects when it is connected to the firearm or when it is removed from the firearm. They can also be electronic and/or mechanical devices that do not function when removed from the firearm. For instance, the electronic device is or includes an authentication unit that is attached to the firearm to perform authentication of the user. As another example, the component is a handle or grip with no electronics or minimal electronics that connects to the firearm to complete the firearm and provide it with a handle.

The modules, components, or modular components are interchangeable, attachable, and removable with one or more mechanical and/or electronic apparatus. For example, a first locking mechanism (including a portion 242A located on or in the firearm and a portion 242B located on or in the module or component) releases or unlocks modules, components, or modular components 220 from the firearm; and a second locking mechanism (including a portion 252A located on or in the firearm and a portion 252B located on or in the module or component) releases or unlocks modules, components, or modular components 230 from the firearm. These locking mechanisms can be mechanical and include by way of example one or more of a release or unlock button or switch, cylinder, latch, magnet, knob, lock, slot, hole, button, rail, tab, hook, pin, switch, lever, recess, groove, actuator, movable device, or other mechanical device to lock and unlock the components. These locking mechanisms can also be or include an electronic device and include by way of example one or more of an electronic switch, solenoid, electronic latch, magnetic lock, other electronic device to lock and unlock the components, or a combination of mechanical and electronic devices.

The firearm 210 also includes a module and/or component determiner 260, and the components and/or modules 220 and 230 include an object identifier 270.

An example embodiment includes automatic identification and data capture (AIDC) of information regarding one or more modules or components connected to the firearm. AIDC refers to methods of automatically identifying objects, capturing or collecting information about the objects, and then automatically entering or providing this information into a computer or electronic device. Examples of AIDC include, but are not limited to, bar codes, RFID, biometrics, magnetic stripes or sources, and other example embodiments discussed herein.

The module and/or component determiner 260 performs one or more functions including by way of example, determining or identifying when a component or module is removed from the firearm, when a component or module is attached to the firearm, when a component or module is turned on or activated, when a component or module is turned off or deactivated, which component or module is connected to or in communication with the firearm, which component or module is proximate to the firearm, which component or module is authorized to connect to or be removed from the firearm, or another function discussed herein.

The object identifier 270 provides a unique or distinct identification of the module or component so it can be identified and/or distinguished from another module or component. By way of example, the object identifier includes a unique number or unique identifier, serial number, an identification number, a part or manufacturing number, a product code, or other number, sequence, code, or identity that distinguishes one module or component from another module or component.

The object identifier can be permanently or integrally formed into or on the module or component or be removable from the module or component. For example, the object identifier is etched on a surface, permanently disposed on or in the module or component, glued or bonded or adhered to the module or component, welded or permanently affixed to the module or component, embedded into or formed as part of the structure of the component (such as surface texture or surface structure identification or microstructure identification), hidden in the module or component, integrally formed or embedded inside the material or a cavity of the module or component.

Consider an example in which the object identifier includes one of a radio frequency identification (RFID) device, a tag, a chip with encoded information, barcode, a near field communication (NFC) tag or device, microchip, readable magnetic strip or medium or other unique mechanical and/or electrical identifier.

Consider an example in which the object identifier 270 includes a passive or an active tag, and the module and/or component determiner 260 reads information stored in the tag while the module or component is connected to the firearm or when the module or component connects or disconnects from the firearm. The firearm then stores and/or transmits this information to another electronic device.

Consider an example in which the first and second locking mechanisms include a button or tab that moves from a first position in which the components are locked or secured to the firearm to a second position in which the components are unlock or removable from the firearm. Consider another example in which the first and second locking mechanisms include a light (such as a light emitting diode or LED) that flashes or shows a light to indicate a status of a module or component. For example, a green light indicates that a user is authenticated to remove or add a component to the firearm; and a red light indicates that a user is not authenticated to remove or add a component to the firearm.

One example embodiment provides a firearm that can be switched between being a firearm with electronics or electronic components to being a firearm without electronics or electronic components. For example, the firearm switches or transforms between a traditional firearm with no electronics and a smart-gun.

Consider an example in which one of components 220 and/or one of components 230 are electronic components that authorize a user to fire the firearm, such as an RFID chip, a proximity token or proximity device, fingerprint recognition, magnetic rings, or biometric sensor and/or verification located inside the components. When these components are connected to the firearm, then the firearm is a smart-gun. One of components 220 and/or one of components 230 are purely or solely mechanical components without electronics or electronic components. When the electronic components are removed from the firearm and replaced with the mechanical components, then the firearm transforms or switches to being a traditional firearm that does not include electronics.

Smart-guns provide a safety feature in that a user must be authorized in order to fire the firearm. Unauthorized users cannot fire the firearm. In some instances, smart-guns cannot be fired in designated areas (e.g., a smart-gun cannot be fired near a school, hospital, or other predetermined area). By contrast, a traditional firearm does not require user authentication, and any user can fire the firearm.

In some instances, a user may want to switch a firearm between being one with electronics and being one without electronics, with minimal electronics, or with deactivated electronics. Consider an example in which a father purchases a firearm assembly that includes a handgun and modular components of an example embodiment. Some of these modular components have electronics that include user authentication, and some of these modular components include no electronics, include only mechanical parts, or are dummy modules. When the handgun is not in use or being stored, modular components are connected to the handgun so it becomes a smart-gun. In this state, an unauthorized user cannot load or fire the handgun. Only an authorized user can load or fire the handgun. These modules prevent a non-authorized person from using the gun. Later, the father takes the handgun to a target range, removes the modular electronic components, and replaces them with mechanical components or dummy components. In this configuration, the handgun operates as a traditional mechanical handgun with no user authentication. When the father is finished firing the handgun at the shooting range, he replaces the mechanical components with the electronic components and transforms the handgun backed to being a smart-gun. He places the smart-gun in its locked case and returns home.

In one example embodiment, the modules, components, or modular components 220 and 230 include traditional components that when connected to the firearm transform the firearm to look, feel, and function like a traditional firearm. Consider an example in which company ABC sells three different types of 9 mm (millimeter) caliber handguns. A first model (called "traditional") has a wood and metal stock, does not include electronic components, and functions in a traditional manner without electronic user authentication. Any user can load, fire, and disassemble the traditional model. A second model (called the "smart-gun") has a wood and metal stock, includes electronic components with fingerprint recognition and functions as a smart-gun. This gun can be fired only by an authorized user after being authenticated with fingerprint recognition or other biometric identification. A third model (called the "modular-gun") has a wood and metal stock and includes multiple components that enable this gun to switch or transition between models similar to or same as the smart-gun model and the traditional model. When the modular-gun has its traditional components connected, the gun looks and functions similar to or identical to the traditional model. When the modular-gun has its electronic components connected, the gun looks and functions similar to or identical to the smart-gun model.

In one example embodiment, the modules, components, or modular components 220 and 230 do not require authentication to remove from or connect to the firearm. Any user can remove and connect these components. In another example embodiment, one or more of these components require user authentication to remove them from or connect them to the firearm. A user must be authenticated to remove and/or connect these components.

Figure 3:
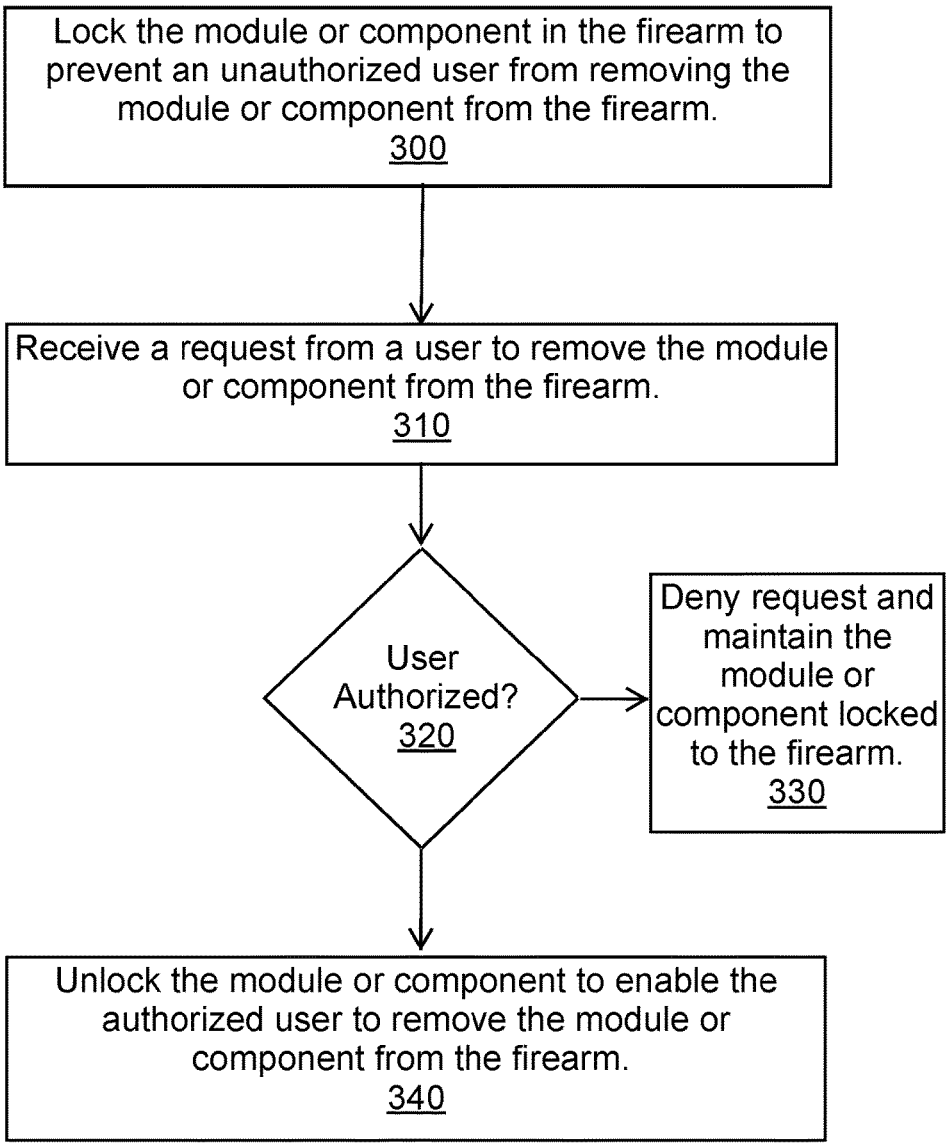
FIG. 3 is a method to authorize a user to remove a component from a firearm in accordance with an example embodiment.

FIG. 3 is a method to authorize a user to remove a component from a firearm.

Block 300 states lock the module or component in the firearm to prevent an unauthorized user from removing the module or component from the firearm.

The module or component is locked to the firearm with a mechanical, electrical, or electromechanical device. For example, when the module or component connects to the firearm, the module or component locks with a locking mechanism and cannot be removed from the firearm.

Block 310 states receive a request from a user to remove the module or component from the firearm.

The request can be made directly to the firearm from the user, such as the request from the user holding the firearm. For example, the user interacts with a user authentication unit or module and/or component determiner to remove the module or component to the firearm. For instance, the user grips the firearm, provides a fingerprint to the firearm, speaks a voice command to the firearm, provides a password to the firearm, or takes another action to authenticate himself or herself to the firearm. Alternatively, the request can be to the firearm from another electronic device, such as the request being made from an electronic or mechanical device that the user holds, wears, or operates. For instance, the user wears or has a proximity token or wearable magnetic device with an encrypted identification that identifies and authenticates the user. As yet another example, the request can be to the firearm from a remote electronic device, such as the request coming from a server or a handheld portable electronic device (such as a smartphone) that is not proximate to but remote from the firearm. As another example, the request can be the act of trying to remove the module or component from the firearm (such as a user trying to unlock and/or remove the module or component from the firearm).

Block 320 makes a determination as to whether the user is authorized to remove the module or component from the firearm.

If the answer to this determination is "no" then flow proceeds to block 330 that states deny the request and maintain the module or component locked to the firearm.

If the answer to this determination is "yes" then flow proceeds to block 340 that states unlock the module or component to enable the authorized user to remove the module or component from the firearm.

An example embodiment prevents an unauthorized user from removing, changing, or swapping a component from the firearm. Consider an example in which Alice buys a handgun according to an example embodiment. The handgun includes a system or kit that enables her to exchange components and transform the handgun from a smart-gun that requires user authentication to fire to a dumb-gun that does not require user authentication to fire. The smart-gun includes a handle with biometric identification so only Alice is authorized to fire the handgun. When this handle is swapped with a conventional handle, any user can fire the handgun. The handgun and its components are stolen. The thieves attempt to fire the handgun, but are unable to do so because handle with the biometric identification does not authorize them as users. The thieves attempt to bypass this security measure and change the handle with the biometric identification with the conventional handle included with the kit. Fortunately, they are unsuccessful since the handle with the biometric identification cannot be removed from the handgun. Only Alice or an authorized user can remove this handle. In response to this unauthorized attempt to remove the handle with the biometric identification, the handgun wirelessly transmits an alert to law enforcement. Alice also notifies law enforcement that her handgun was stolen.

Consider the example above in which the thieves steal Alice's handgun. The body of the handgun, the modules, and/or components include a tracking mechanism, such as a tag, GPS chip, or transmitter that is embedded into or immovable from the device. For example, the transmitter can be queried for its GPS location. Alternatively, the transmitter begins generating and transmitting a location signal upon activation (example, remote activation from an electronic device, such as a smartphone, or upon an authorized attempt to remove or add a module and/or component to the firearm).

Consider an example in which a rifle has interchangeable stocks (or buttstocks) that removably connect to vary a length of the rifle. When the user is authenticated, then the user can load and fire the rifle and remove and add stocks of different lengths to the rifle. If the user is not authenticated, then the user cannot load the rifle, fire the rifle, or remove and/or add a stock to the rifle. For example, the locking mechanism locks the hammer or firing pin to prevent the rifle from firing, locks the magazine ejection button to prevent a user from ejecting the magazine and loading cartridges, and locks an engagement that connects the stock to the rifle.

Figure 4:
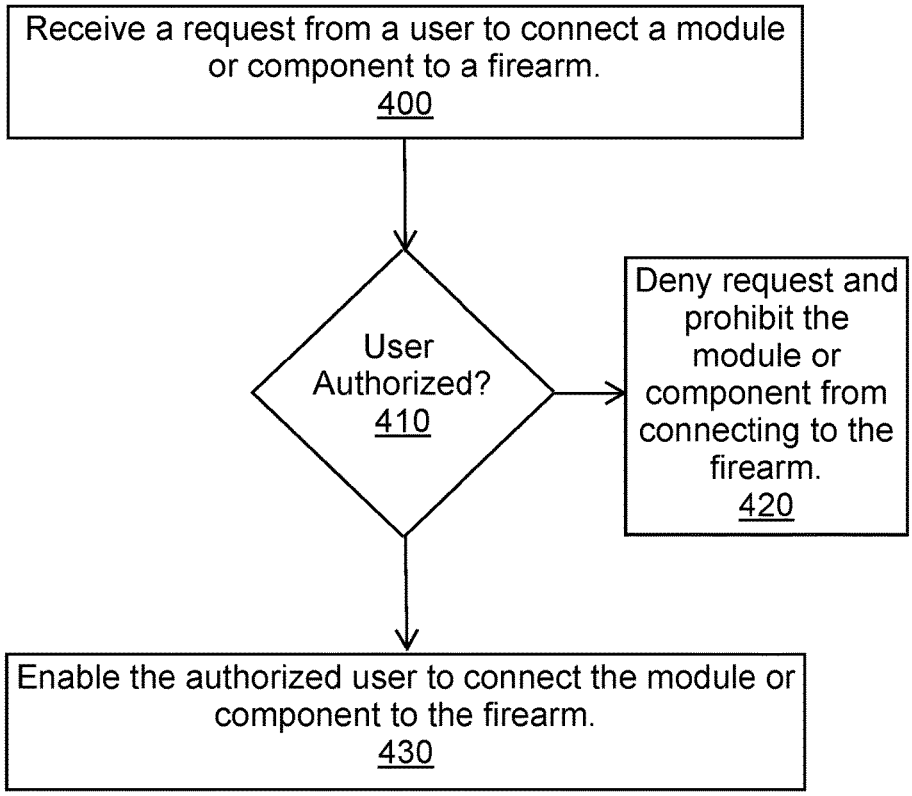
FIG. 4 is a method to authorize a user to connect a component to a firearm in accordance with an example embodiment.

FIG. 4 is a method to authorize a user to connect a component to a firearm.

Block 400 states receive a request from a user to connect a module or component to a firearm.

The request can be made directly to the firearm from the user, such as the request from the user holding the firearm. For example, the user interacts with an authentication unit to connect the module or component to the firearm. For instance, the user grips the firearm, provides a fingerprint to the firearm, speaks a voice command to the firearm, provides a password to the firearm, or takes another action to authenticate himself or herself to the firearm. Alternatively, the request can be to the firearm from another electronic device, such as the request being made from an electronic or mechanical device that the user holds, wears, or operates. For instance, the user wears or has a proximity token or wearable magnetic device with an encrypted identification that identifies and authenticates the user. As yet another example, the request can be to the firearm from a remote electronic device, such as the request coming from a server or a handheld portable electronic device (such as a smartphone) that is not proximate to but remote from the firearm. As another example, the request can be the act of trying to connect the module or component to the firearm (such as a user trying to insert, engage, or position the module or component onto the firearm).

Block 410 makes a determination as to whether the user is authorized to connect the module or component to the firearm.

If the answer to this determination is "no" then flow proceeds to block 420 that states deny the request and prohibit the module or component from connecting to the firearm.

If the answer to this determination is "yes" then flow proceeds to block 430 that states enable the authorized user to connect the module or component to the firearm.

An example embodiment prevents an unauthorized user from connecting a component to the firearm. Consider an example in which Bob buys a handgun according to an example embodiment. The handgun includes a system or kit that enables him to exchange components and convert the handgun from being a smart-gun that requires authentication to fire to being a dumb-gun that does not require user authentication to fire. Specifically, the kit includes a body portion (barrel, action, and trigger) with no handle and two different handles (a smart-gun handle and a traditional handle) that attach to the body portion. The body portion cannot fire a bullet without one of the handles being connected. When the smart-gun handle is connected to the handgun, only Bob can fire the handgun since he is the only authorized user. When the traditional handle is connected to the handgun, any user can fire the handgun. Bob's son (Jake) discovers the kit that includes the handgun disassembled into three different components: the main body, the smart-gun handle, and the traditional handle. Jake knows that he is not authorized to shoot the smart-gun so he attempts to connect the traditional handle to the main body. Jake believes that if he can get the traditional handle connected to the main body, then he can fire the handgun. Fortunately, the handgun will not allow Jake to connect the traditional handle to the main body. The main body and the traditional handle include a locking mechanism with an electromechanical latch in a closed position. When this latch is in the closed position, the traditional handle cannot engage and lock to the main body. Only an authorized user (in this instance, Bob) can release and open the latch and allow the traditional handle to connect to the main body.

Consider an example in which a handgun is sold in two main pieces or components that are removable from each other: (1) a main body that includes the action, trigger, and barrel, and (2) a handle that includes a magazine. The main body and handle can be further disassembled into smaller parts for cleaning, repair, or maintenance. The main body, however, includes an electro-mechanical locking mechanism, such as a solenoid bolt. When the main body disconnects from the handle, the locking mechanism transitions to a fail close position. In this position, the handle cannot engage and connect to the main body. Further, this position can also freeze or lock a firing pin so the firearm cannot be fired. In order to unlock the locking mechanism, a user must be authenticated to use the firearm. For instance, the main body includes or is connectable to a power source with user authentication. When the user is authenticated, the locking mechanism unlocks so the user can connect the handle to the main body. When the user is finished with the firearm, he or she unlocks the handle from the main body. Thereafter, an unauthorized user cannot fire the firearm since the firing pin is frozen. Further, this unauthorized user would not even be able to connect the handle to the main body to assemble the firearm.

Consider an example in which an elongated cylindrical gun suppressor with no electronics or electrical components has one end with a threaded bore or other connector that enables the suppressor to removable connect to an end of a firearm. This end of the suppressor also includes a recess, indentation, ledge, shoulder, or other structure as part of a locking mechanism. The firearm includes a complimentary part of the locking mechanism, such as an arm, lever, pin, cylinder, or other extension that moves into and out of the recess to lock and unlock the suppressor. When the suppressor fully seats or connects to the barrel of the firearm, a "connect" signal activates the arm of the locking mechanism to move into the recess and lock the suppressor. Thereafter, the suppressor cannot be removed until a "disconnect" signal activates the arm of the locking mechanism to move out of the recess. This disconnect signal can be generated in response to a user being authenticated to the firearm.

Consider further the example above of the suppressor. When the suppressor unlocks from the firearm (example, in response to user authentication), the arm of the locking mechanism moves out of the recess. When the suppressor is removed from the firearm, the locking mechanism automatically moves the arm back to the lock position even though no suppressor is connected to the firearm. Thereafter, when an unauthorized user attempts to connect or engage the suppressor to the firearm, the arm hits or contacts the end of the suppressor and prevents it from seating or connecting to the firearm. As such, the unauthorized user is not able to connect the suppressor to the firearm. When an authorized user attempts to connect the suppressor to the firearm, the locking mechanism moves the arm out of the recess to the lock position and then moves it back into the lock position when the locking mechanism receives the connect signal.

Consider an example in which a shotgun includes a removable plug that limits or restricts the number of shotgun shells that can be loaded into the gun. An outer surface of the plug includes a round or hemispherical recess. When the plug inserts into the shotgun, a locking mechanism actuates an end of a cylindrical rod to move into the recess that prevents the plug from being removed. The locking mechanism cannot be activated to remove the rod from the recess unless instructed by an authorized user of the shotgun.

Consider an example in which a firearm (such as a handgun or rifle) can accept different size magazines or clips that include low-capacity magazines and high-capacity magazines. Regulations govern whether a user is authorized to insert a high-capacity magazine (such as a federal or state law stating a magazine cannot hold more than eight rounds or ten rounds). The firearm includes a component determiner, and the handle or magazine receiver on the firearm includes a locking mechanism. This locking mechanism moves a pin or rotates a hook, latch, or other component such that the magazine cannot be inserted into the handle or magazine receiver without user authentication. Alternatively, the magazine can only be partially inserted into the handle or magazine, or can be inserted but cannot fully engage the firearm. In any event, the firearm is not operable to dispense ammunition from the magazine unless the user is authorized and/or the locking mechanism actuates to accept and lock to the magazine. When a user attempts to load a magazine into the firearm, the component determiner reads an identifier on the magazine. The firearm (or an electronic device in communication with the firearm) consults a lookup table to determine what restrictions are applicable to the magazine being inserted into the firearm (e.g., any user can insert the magazine, only certain authorized users can insert the magazine, or no one can insert the magazine because it is illegal). If the user is not authorized or the magazine is not legal in the firearm, then the locking mechanism prohibits the magazine from being inserted into or engaging with the firearm.

Consider another example in which John purchases a firearm assembly that includes components that allow him to transform the firearm from a semi-automatic firearm to a fully automatic firearm. The fully automatic firearm can only be legally fired by users with a particular federal government license, certification, National Firearms Act (NFA) tax stamp, or other requirement. John has a NFA permit to fire the fully automatic version of the firearm, and hence the locking mechanism in the firearm allows John to transform the gun from being a semi-automatic to a fully automatic. Later, John's NFA permit expires, and he no longer has a valid federal license to shoot the automatic weapon. John is unaware that his license has expired. The federal government transmits a signal to John's firearm instructing that John is no longer authorized to fire the fully automatic weapon. In response to this signal, the locking mechanism actuates. When John subsequently attempts to fire the automatic weapon or convert it from being a semi-automatic weapon to an automatic weapon, the locking mechanism prohibits John from doing this. A display on the firearm instructs John that his NFA permit has expired.

Figure 5:
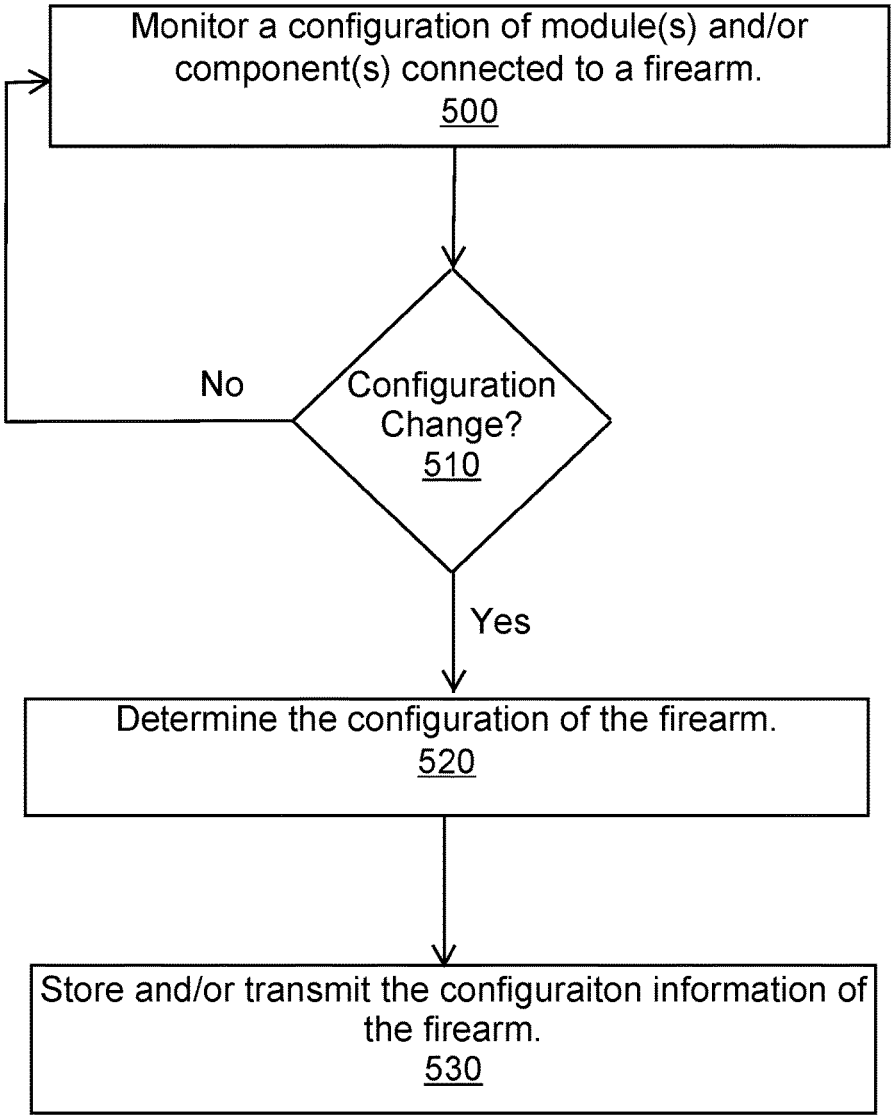
FIG. 5 is a method to store configuration information of a firearm in accordance with an example embodiment.

FIG. 5 is a method to store configuration information of a firearm.

Block 500 states monitor a configuration of module(s) and/or component(s) connected to a firearm.

The firearm or another electronic device determines which modules or components are connected to the firearm. For example, each module or component has a unique identification or unique identifier that can be read by the firearm or another electronic device. Examples of unique identifiers include, but are not limited to, a data tag or other tag that includes a unique tag value, a radio frequency identification (RFID) device, chip with encoded information, barcode, a near field communication (NFC) tag or device, readable magnetic strip or medium, proximity card or device, contactless smart card or device, bokode, Quick Response (QR) code, a unique mechanical fingerprint or signature (such as a unique material structure), or other unique mechanical and/or electrical identifier.

The module(s) and/or component(s) connected to the firearm are stored in memory. In this manner, the firearm and/or an electronic device in communication with the firearm knows which module(s) and/or component(s) are currently connected to the firearm.

Block 510 makes a determination as to whether the configuration of the firearm changes.

A configuration of the firearm changes when a module and/or component is added to, removed from, disabled, or enabled on the firearm. For example, a user removes a component from the firearm, replaces a component on the firearm, turns off or deactivates a component on the firearm, or turns on or activates a component on the firearm.

If the answer to the determination is "no" then flow proceeds back to block 500.

If the answer to the determination is "yes" then flow proceeds to block 520 that states determine the configuration of the firearm.

As stated in connection with block 500, the firearm and/or another electronic device determines the configuration of the firearm for which module(s) and/or component(s) are connected to, removed from, enabled on, and/or disabled on the firearm. Additionally, this information can be provided by the user, another person, or another electronic device besides or in addition to the firearm.

Block 530 states store and/or transmit the configuration information of the firearm. For example, the firearm and/or another electronic device stores the configuration information in memory and/or wirelessly transmits it to another electronic device, such as a handheld portable electronic device (HPED), desktop computer, server, etc.

An example embodiment provides a safety or security feature that is separate from other safety features, such as a mechanical safety switch or biometric user authentication. This safety feature includes tracking or determining when the firearm is taken apart (such as removing a module or component), when the firearm is assembled (such as assembling the firearm together after it is disassembled), when a feature of the firearm is enabled or turned on (such as turning on a feature of a module or component), or when a feature of the firearm is disabled or turned off (such as turning off a feature of a module or component).

In addition to tracking or determining these safety features, an example embodiment records this information as configuration information of the firearm. The firearm is thus able to determine and record a history or events about the firearm and its configuration information. This configuration information includes, but is not limited to, what module(s) and/or components(s) are connected to the firearm, what changes occur to the configuration of the firearm (e.g., when a module and/or component of the firearm is added to, removed from, replaced, repaired, turned on, activated, deactivated, or turned off), logging or storing firing information (such as when a firearm is fired, where a firearm is fired, who fires the firearm, how many rounds are fired from the firearm, what times/dates the firearm is fired, etc.), an identity of a user that performed or authorized the change to the configuration, a date, a time, and a location when the change to the configuration occurred. The configuration information can also include a global positioning system (GPS) or location of where this configuration information occurred. Furthermore, this configuration includes a time or duration for how long the firearm was in a certain configuration (e.g., how long in time a certain component was connected to or removed from the firearm).

Consider an example in which a user desires to convert the firearm from a smart-gun that requires user authentication to fire to a conventional firearm that any user can fire. The user authenticates himself to the firearm and then deactivates user authentication for a period of three hours. The firearm records configuration information that includes the name of the user deactivating user authentication, and a time, date, and location where the firearm was located when the deactivation occurred. Before deactivating the user authentication, the firearm stores this information in a tamper-proof memory and wirelessly transmits this information to a secure server.

Consider an example in which Bob and Charlie are both authorized users of a handgun. Bob cleans the handgun, removes the grip, and stores the handgun as two-pieces (main body and grip) in a locked cabinet. Later, Charlie unlocks the cabinet and assembles the grip to the main body. When the grip attaches and locks to the main body, the locking mechanism activates a switch that causes the firearm to record configuration information that includes a timestamp when the grip connected to the main body, a GPS location of the handgun when the grip connected to the main body, and an identity of Charlie as the authorized user who connected the grip to the main body. The firearm encrypts this configuration information, stores it in an activity log, and transmits the configuration information to a software application that executes on Bob's smartphone that displays the configuration information and activity log to Bob.

Consider further the example in which Charlie assembles the firearm. When Charlie attaches the grip to the main body, the switch also triggers a timer (such as a timer in the electronics of the firearm or a remote timer on a server). This timer records a duration of time that the grip is connected to the main body. Later, when Charlie removes the grip from the main body of the firearm, the time stops recording the time.

Consider an example in which Bill is the only authorized user of an AR-15 rifle with a tactical folding stock adapter. Bill stores the gun in a locked gun cabinet with the rifle folded at a hinge assembly. The gun cannot be fired in this unfolded position. Thereafter, Bill agrees to allow his son (Luke) to take the gun and shoot it at a firing range. Luke unlocks the gun from the cabinet and takes it to the firing range. When Luke attempts to fold back the gun, a locking mechanism adjacent the hinge assembly prevents the hinge assembly from latching. Luke cannot fold the gun back to an operable configuration. Luke telephones Bill and explains the problem. Bill executes a software application on his smartphone that communicates with the AR-15 and sends an "unlock" command. Upon receiving this command, the locking mechanism of the AR-15 disengages and allows Luke to fold and lock the gun at the hinge assembly.

Consider an example in which an unauthorized user removes or adds a component to a firearm. The firearm allows the user to add or remove the component, but in response to this action, the locking mechanism freezes the trigger or action mechanism. Thereafter, the firing pin cannot activate or move to strike and fire a cartridge from the firearm.

Figure 6:
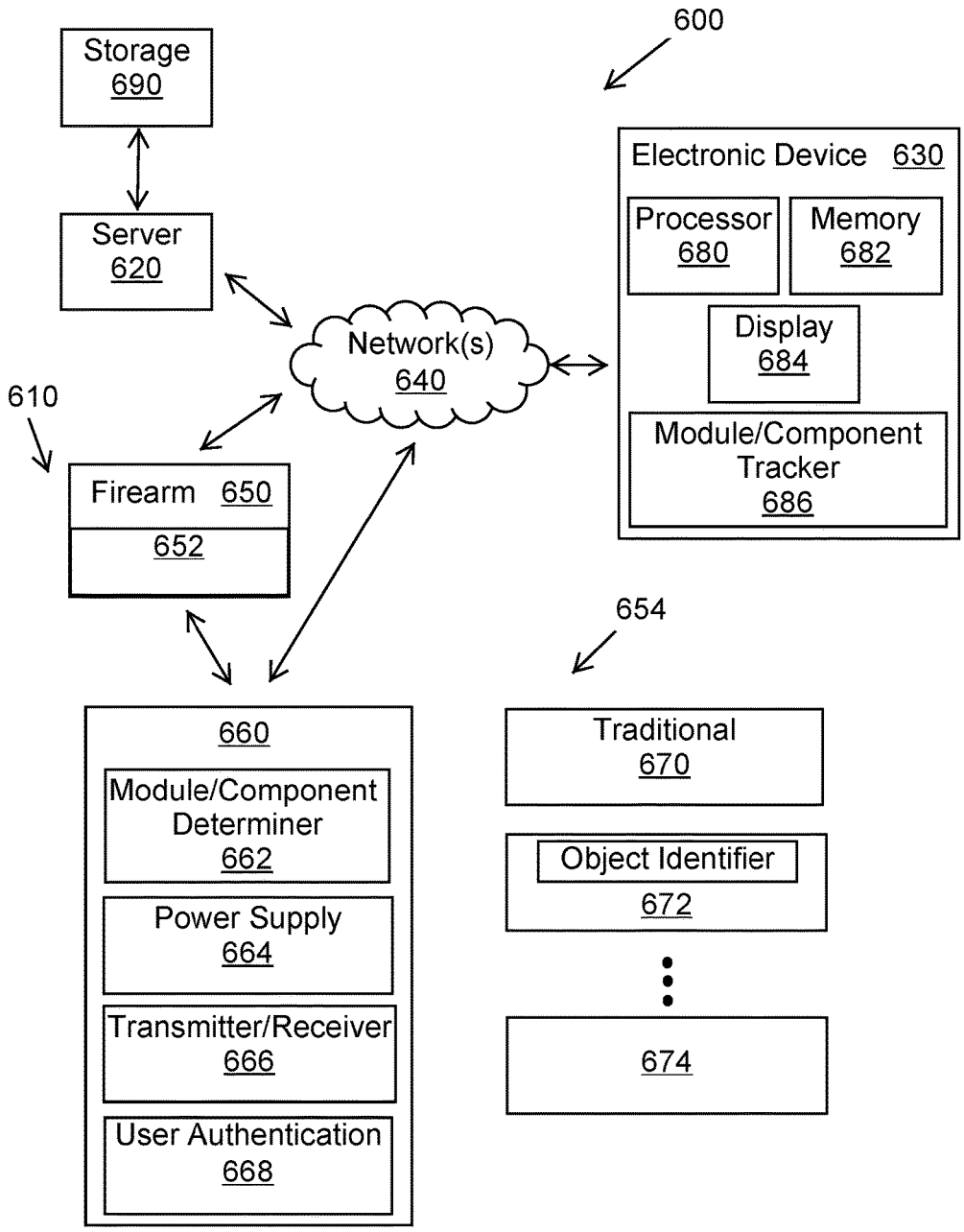
FIG. 6 is a computer system that includes a firearm assembly with a plurality of modules or components in accordance with an example embodiment.

FIG. 6 is a computer or electronic system 600 that includes a firearm system or assembly 610, a server 620, and an electronic device 630 in communication over one or more networks 640.

The firearm assembly 610 includes an assembled or completed firearm 650 with one or more modules or components 652 attached to and formed as part of the completed firearm. The firearm assembly 610 also includes a plurality of modules and/or components 654 that can replace the modules or components 652. These modules and/or components 654 include example embodiments discussed herein.

By way of example, module or component 660 includes a module/component determiner 662 that determines which modules and/or components are connected to the firearm, a power supply 664 (such as a battery), a wireless transmitter/receiver 666, and user authentication 668 (such as biometric authentication, fingerprint authentication, password authentication, etc.).

Module or component 670 is a traditional component that does not include any electronics. Module or component 672 includes only an object identifier with no other electronic components. Box 674 shows other modules and/or components connectable to the firearm 650 (such as other modules and/or components discussed herein).

Electronic device 630 includes a processor 680 (such as a microprocessor a processing unit), a memory 682, a display 684, and a module/component tracker 686 (such as a software application that communicates with the firearm to track configuration information discussed herein).

Examples of electronic devices include, but are not limited to, servers, desktop computers, tablet computers, smartphones, laptop computers, handheld portable electronic devices (HPEDs), and other portable and non-portable computers and electronic devices.

The server 620 communicates with storage 690 (such as memory that stores configuration information received from firearms or HPEDs of users of the firearms).

Figure 7:
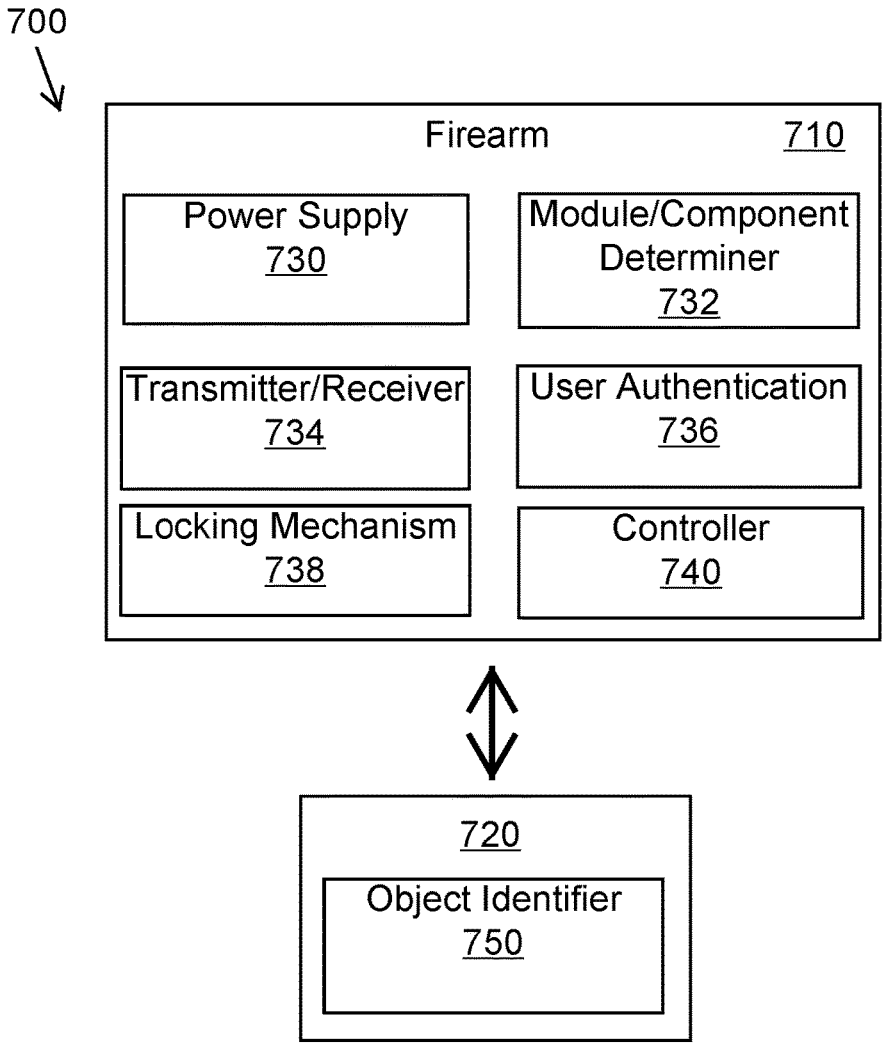
FIG. 7 is a firearm assembly in accordance with an example embodiment.

The firearm and/or one or more of the modules or components can include the module or component determiner. For example, FIG. 7 shows a firearm assembly 700 that includes a firearm 710 with a removable module and/or component 720. For illustration, a single module or component is shown but other modules or components can also be includes per example embodiments.

The firearm 710 includes a power supply 730, a module or component determiner 732, a transmitter/receiver 734, a user authentication 736, a locking mechanism 738, and a controller 740. The module or component 720 includes an object identifier 750.

By way of example, the controller 740 is a chip that controls and/or manages the electronic components, such as the locking mechanism 738, based on information received from the user authentication 736, module or component determiner 732, and/or object identifier 750. The controller can be a single integrated circuit on a printed circuit board, a plug-in-board, chip, or another device. Further, the controller can also be a microcontroller that is a small computer (SoC) on a single integrated circuit that includes a memory, a processor core, and/or programmable input/output peripherals.

Consider an example in which a firearm includes a module/component determiner as a RFID or tag reader. When a component is connected to or removed from the firearm, the determiner identifies the component, records a timestamp, and transmits this information (along with an identity of a user removing or connecting the module or component) to an electronic device (such as a server or HPED).

Consider an example in which the user authentication 736 communicates with the locking mechanism 738. When a user is not authorized to remove, add, activate, or deactivate a component, the user authentication communicates with the locking mechanism to provide a locking state or enablement state in accordance with the authentication determination.

Consider an example in which the power supply 730, module/component determiner 732, transmitter/receiver 734, and user authentication 736 are disposed on a printed circuit board that is a removable component from the firearm. When the component is removed from the firearm, a switch or trigger generates an alert, and the component transmits a "remove signal" to a server or other electronic device. Thereafter, the component continues to transmit information to the server or electronic device. Such information includes, but is not limited to, a GPS location, a time and date, a proximity to the firearm, an identity of the user, or other configuration information discussed herein. During this time, the firearm may not be operable. Alternatively, during this time, the firearm is operable as a traditional firearm.

Consider another example in which the power supply 730, module/component determiner 732, transmitter/receiver 734, and user authentication 736 are disposed on a printed circuit board that is not a removable component from the firearm. For example, the PCB is embedded inside the housing of the main body of the firearm or in a handle or stock that permanently connects to the firearm. Furthermore, this PCB can be enclosed or encased in a tamper-proof housing and permanently connected to or located inside the body of the firearm.

Consider an example in which a removable buttstock of a rifle includes an end with a magnetic tag, RFID, or other passive component with a unique identifier. The rifle includes a reader or transmitter that reads the unique identifier when this end of the buttstock attaches to the rifle.

Consider an example in which an AR-15 rifle has a foldable body with a hinge assembly such that the rifle can fold in two or more places (such as a side-fold, under-fold, or other fold). The rifle folds at the hinge assembly, and a locking mechanism locks and unlocks the two components together. When the rifle is unfolded, the rifle cannot be connected back together unless a user is first authenticated. When the user is not authenticated, the locking mechanism moves a pin or latch adjacent to the hinge assembly to a closed position such that the two foldable pieces cannot latch or lock together. When the user is authenticated, the locking mechanism moves the pin or latch to an open position so the two foldable pieces can engage and lock together.

Consider an example in which a memory (such as memory in the firearm or memory in an electronic device in communication with the firearm) stores authentication information for each component and each configuration of the firearm. The firearm assembly knows which users are authorized to perform which actions with respect to each component. For example, the firearm assembly knows which users are authorized to remove which components, attach which components, assembly the firearm, disassemble the firearm, fire the firearm with each different component and/or configuration, etc.

By way of example, the modules, components, and modular components can include, but are not limited to, one or more of a camera, a laser, a scope (such as an electronic scope), a sensor (such as micro-electro-mechanical systems sensor, a motion sensor, an optical sensor, radio-frequency identification sensor or RFID device, a solid state compass, gyroscope, and an accelerometer), a global positioning system or GPS, a distance determiner (such as a laser, a rangefinder, and a camera), an orientation determiner (such as a tilt sensor, inclinometer, and/or an accelerometer), or another electronic component or device. Furthermore, a module, component, and/or modular component can include one or more of memory, processor (including a microprocessor, controller, or microcontroller), sensor(s), wireless transmitter/receiver, user interface, display, or other electronic component.

The modules or components of example embodiments can be accessories or add-ons. An accessory is something added to a firearm to make it more useful, attractive, or effective. Examples of accessories include, but are not limited to, a scope that removably mounts to a barrel or body of the firearm, a gun case or gun holster that carries or stores a firearm, an extra magazine clip that stores additional rounds of ammunition, a silencer or muffler that connects to the barrel of the firearm to suppress noise, a removable sight that attaches to the barrel of the firearm, a strap or sling for carrying the firearm, a removable plastic or rubber grip that fits around the handle of the firearm, a rangefinder or laser that removably attaches to the firearm, or another electronic or mechanical device that removably attaches to the firearm. Accessories or add-ons are not original components to the manufactured firearm.

Instead of being an accessory or an add-on, the modules and/or components of an example embodiment can form part of the firearm and can be a basic component of the firearm itself. For example, a module or a component forms or is a basic or core component of the firearm (such as the handle or grip), and the firearm cannot function or work properly when the module or component is removed. For example, when the firearm is sold, it includes the module and/or component already attached to the firearm since it forms a part of the original firearm. For instance, when the handle module or handle component is removed, then the firearm does not have a handle and, as such, cannot be fired or cannot be fired safely. In this instance, the module or handle forms a basic or core component of the firearm itself such that the firearm is not complete and/or not functional when the module or component is removed. As another example, the module or component can form or be the barrel assembly or housing of the firearm such that when the module or component is removed, then the firearm is not complete. In some instances, the firearm cannot fire or operate correctly if a module or component is removed and not connected to the firearm. In this sense, the modules and components can be distinguished from an add-on or an accessory to a firearm.

As used herein, a "module" is one of a set of parts that can be connected to build or complete a firearm. Each module can have a different set of electronic and/or mechanical components to provide the firearm with different functions depending on which module is connected to the firearm.

As used herein, a "smart gun" is a firearm that includes electronics and can only be fired by an authorized user and/or only fired in an authorized area.

As used herein, a "traditional firearm" is a firearm that does not include electronic components.

The methods and apparatus in accordance with example embodiments are provided as examples, and examples from one method or apparatus should not be construed to limit examples from another method or apparatus. Further, methods and apparatus discussed within different figures can be added to or exchanged with methods and apparatus in other figures. Further yet, specific numerical data values (such as specific quantities, numbers, categories, etc.) or other specific information should be interpreted as illustrative for discussing example embodiments.

What is claimed is:

1. A method that enables an authorized user to switch a handgun from being a smart-gun to being a traditional handgun, the method comprising:

providing the handgun with a first component that removably connects to the handgun, that forms at least part of a handle of the handgun, and that includes electronics that make the handgun the smart-gun that can only be fired by the authorized user;

providing the handgun with a second component that removably connects to the handgun when the first component is removed from the handgun, that forms at least part of the handle of the handgun when the first component is removed from the handgun, that does not include an electronic component, and that replaces the first component in order to switch the handgun from being the smart-gun to being the traditional handgun that does not include electronic components;

receiving, at the handgun when the first component is connected to the handgun, a request from the authorized user to remove the first component from the handgun;

unlocking, by the handgun and in response to the request, the first component from the handgun when the authorized user is authorized to remove the first component from the handgun; and locking, at the handgun, the second component that forms at least part of the handle in order to switch the handgun from being the smart-gun to being the traditional handgun.

2. The method of claim 1 further comprising:

locking, by the handgun, the first component to the handgun such that the first component can only be unlocked and removed from handgun by the authorized user.

3. The method of claim 1 further comprising:

locking, with a lock in the handgun and after the authorized user is authenticated and removes the first component from the handgun, the second component to the handgun to transform the handgun from being the smart-gun to being the traditional handgun.

4. The method of claim 1 further comprising:

generating, by the handgun, a first timestamp when the authorized user removes the first component from the handgun;

generating, by the handgun, a second timestamp when the authorized user connects the second component to the handgun and transforms the handgun from being the smart-gun to being the traditional handgun; and transmitting, by the handgun, the first timestamp and the second timestamp to a remote server.

5. The method of claim 1 further comprising:

transmitting, by the handgun and to a server, configuration information that includes a time and a date when the first component was connected to the handgun and a time and date when the first component was removed from the handgun.

6. The method of claim 1 further comprising:

sensing, with a sensor in the handgun, an identity of the first component when the first component connects to the handgun; and transmitting, by the handgun and to a server, the identity of the first component and a name of the authorized user who was authorized to connect the first component to the handgun.

7. The method of claim 1, wherein the second component is a dummy component that fills an empty location left in the handle of the handgun after the first component is removed from the handgun.

8. A handgun assembly, comprising:

a handgun that includes a frame with a hand grip, a barrel through which a bullet travels, an action that fires the bullet, and a trigger that activates the action to fire the bullet;

a first component that removably attaches to the hand grip, includes electronics of a power supply and an authentication unit that authenticates a user of the handgun to fire the handgun, and transforms the handgun into a smart-gun when connected to the handgun; and a second component that removably attaches to the hand grip to replace the first component, does not include any electronics, and transforms the handgun into a tradition handgun without electronic components when connected to the handgun, wherein the smart-gun is a firearm that can only be fired by an authorized user.

9. The handgun assembly of claim 8, wherein the second component is a dummy component that fills an empty location left at the hand grip of the handgun after the first component is removed from the handgun.

10. The handgun assembly of claim 8, wherein the authentication unit locks the first component to the hand grip such that the first component cannot be unlocked and removed from the handgun until the authentication unit authorizes the user to remove the first component from the handgun.

11. The handgun assembly of claim 8, wherein the authentication unit unlocks the first component from the hand grip in response to the authentication unit authorizing the user to remove the first component from the handgun.

12. The handgun assembly of claim 8, wherein the first component includes a laser rangefinder, a Global Positioning System (GPS), and a wireless transmitter and receiver.

13. The handgun assembly of claim 8, wherein the handgun cannot be fired when the first component and the second component are removed from the handgun.

14. A method that enables a user to switch a handgun from being a smart-gun to being a traditional handgun, the method comprising:

providing the handgun with a first component that removably connects to a barrel of the handgun and that includes electronics that make the handgun the smart-gun that can only be fired by the user;

providing the handgun with a second component that removably connects to the barrel of the handgun when the first component is removed from the handgun, that does not include an electronic component, and that replaces the first component in order to switch the handgun from being the smart-gun to being the traditional handgun that does not include electronic components;

receiving, at the handgun when the first component is connected to the handgun, a request from the user to remove the first component from the handgun;

unlocking, with a lock in the handgun and in response to receiving the request, the first component from the barrel of the handgun when the user is authorized to remove the first component from the handgun; and locking, with the lock and to the barrel of the handgun after the first component is removed, the second component in order to switch the handgun from being the smart-gun to being the traditional handgun.

15. The method of claim 14 further comprising:

receiving, at the handgun, a request from the user to remove the barrel from the body of the handgun;

unlocking, by the handgun, the barrel from the body of the handgun when the user is authorized to remove the barrel from the handgun; and maintaining, by the handgun, the barrel locked to the handgun when the user is not authorized to remove the barrel from the handgun.

16. The method of claim 14 further comprising:

generating a timestamp that indicates a date and time when the first component is removed from the handgun; and wirelessly transmitting the timestamp from the handgun to an electronic device.

17. The method of claim 14 further comprising:

providing the barrel with a unique identification; and identifying, by the handgun, the unique identification of the barrel when the barrel is connected to the handgun.

18. The method of claim 14 further comprising:

determining, by the handgun, configuration information that includes a time, a date, and a global positioning system (GPS) location when the barrel is removed from the handgun; and transmitting the configuration information from the handgun to a server.

19. The method of claim 14 further comprising:

receiving, at the handgun, a request from the user to connect the barrel to a body of the handgun;

unlocking, by the handgun, a locking mechanism to enable the barrel to connect to the body of the handgun when the user is authenticated to connect the barrel to the handgun; and maintaining, by the handgun, the locking mechanism locked so the user is unable to connect the barrel to the body when the user is not authenticated to connect the barrel to the body.

20. The method of claim 14, wherein the first component and the second component connect to an underside of the barrel.

* * * * *